United States Patent [19]

Moretti et al.

[11] 4,292,692

[45] Oct. 6, 1981

[54] SELF-SETTING ADJUSTABLE HEADBAND

[75] Inventors: Anthony L. Moretti, San Rafael; Lester W. Ferris, Tiburon, both of Calif.

[73] Assignee: E. D. Bullard Company, Sausalito, Calif.

[21] Appl. No.: 131,252

[22] Filed: Mar. 17, 1980

Related U.S. Application Data

[63] Continuation-in-part of Ser. No. 33,549, Apr. 26, 1979, abandoned, which is a continuation-in-part of Ser. No. 953,481, Oct. 23, 1978, abandoned.

[51] Int. Cl.[3] ..... A42B 3/00

[52] U.S. Cl. ..... 2/418; 24/206 R

[58] Field of Search ..... 2/417, 418, 178, 183, 2/197; 24/169, 198, 206 R, 206 A, 16 PB, 206

[56] References Cited

U.S. PATENT DOCUMENTS

| | | | |
|---|---|---|---|
| 2,283,094 | 5/1942 | Ruskin | 24/206 R |
| 2,455,236 | 11/1948 | Darvie et al. | 24/206 R |
| 3,329,968 | 7/1967 | Gordon | 2/418 |
| 3,696,440 | 10/1972 | Littleton | 2/418 |

*Primary Examiner*—Louis Rimrodt

*Attorney, Agent, or Firm*—Phillips, Moore, Weissenberger, Lempio & Majestic

[57] ABSTRACT

An improved headband is disclosed which is readily adjustable in size and which is self-setting to automatically accommodate a wearer having a head of a larger size than the size to which the headband is adjusted. The headband is useful in a suspension system for a safety hat or the like.

17 Claims, 11 Drawing Figures

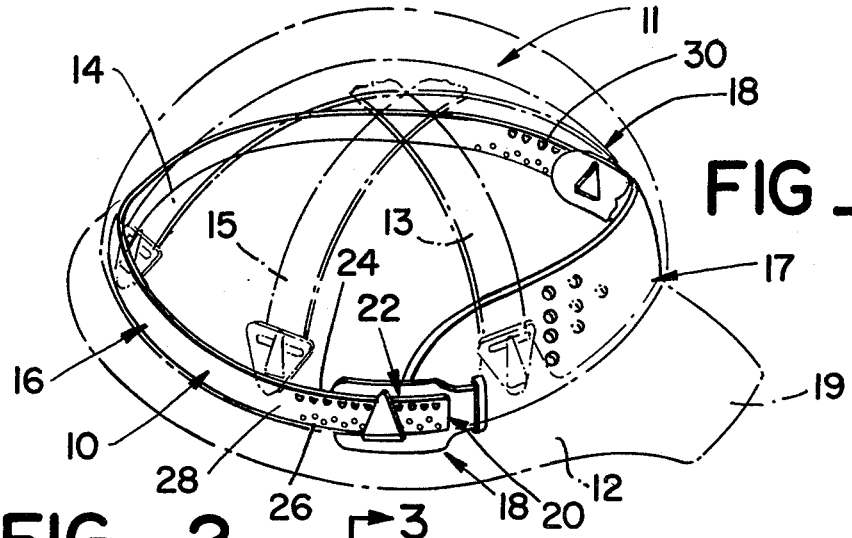
FIG_1
FIG_2
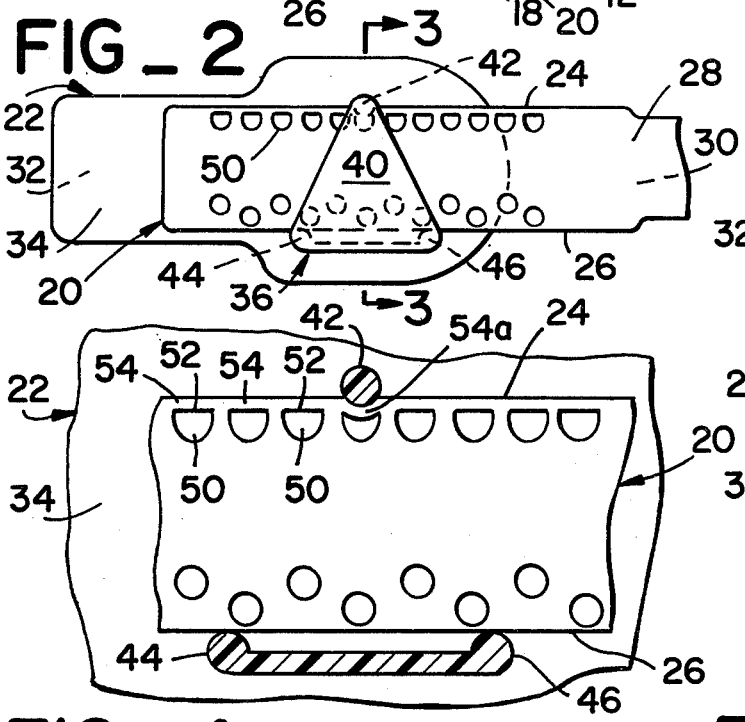
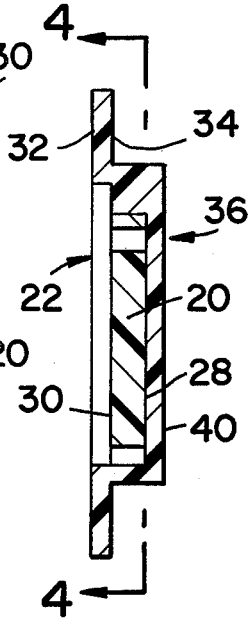
FIG_4
FIG_3
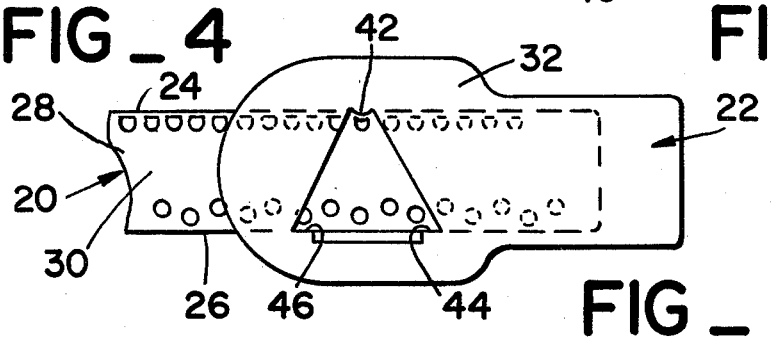
FIG_5

SELF-SETTING ADJUSTABLE HEADBAND

CROSS-REFERENCE TO OTHER APPLICATION

This application is a continuation-in-part of application Ser. No. 033,549, filed Apr. 26, 1979, now abandoned which is a continuation-in-part of application Ser. No. 953,481, filed Oct. 23, 1978, now abandoned.

BACKGROUND OF THE INVENTION

1. Field of the Invention

This invention relates to a headband for use in a helmet suspension system or the like and more particularly to the means by which the size of the headband is made adjustable.

2. Prior Art

Safety hats, or helmets, are conventionally known and usually include a helmet shell and a suspension system. Such helmets are useful, for example, on construction sites or during fire fighting activities. The helmet shell is normally designed of rigid materials with high impact resistance for protection of the wearer's head.

The suspension system for such helmets performs two main functions: it retains the safety helmet in place on the head of a wearer as the wearer moves about; and it establishes and maintains a clearance space between the head of the wearer and the shell of the helmet, the space protecting the wearer's head against falling objects that impinge on the shell.

The primary retention of the safety helmet in place on the head of the wearer as the wearer moves about is performed by a headband which encircles the head of the wearer, and a clearance space for the wearer's head is established by crown straps that extend from a region adjacent the rim of the shell to a point over the crown of the wearer's head and back to the helmet rim at the point diametrically opposite the region adjacent the rim. An example of a safety helmet suspension system which includes a headband and crown straps, both of which are attached to a helmet shell, is disclosed in the U.S. Pat. No. 3,555,560.

Where one would wish, or be required, to wear a safety helmet, it is common practice to store a group of safety helmets for ready access by whomever needs a helmet, either for a person scheduled to wear a helmet or for temporary visitors. That is, safety helmets are desirably and conventionally designed to be interchangable between persons with different head sizes, usually by adjustment of the headband. A variety of headband adjustment methods are known to the art, for example, as is disclosed in U.S. Pat. No. 3,555,560.

Hitherto, adjustments of headbands have required the headband to be manually urged into the desired circumferential size, fastened affixedly into the desired size, and then placed upon one's head. Often, this headband adjustment procedure must be repeated one or more times before a tight, but comfortable fit is achieved.

It is very important that a headband of a safety helmet be tight enough to retain the safety helmet upon one's head and maintain the safety helmet position throughout the entire gamut of expected head motions; it is also important that the headband be comfortably fitted, or else the wearer will have a tendency to push the helmet back, or to take it off entirely.

Finally, it is desirable that the fastening device which holds the headband into the desired circumferential size does not yield if an object falls upon or strikes the safety helmet. Should the fastening device of such a headband yield even in permitting lateral motion of one portion of the headband with respect to another portion of the headband, then the safety helmet may be thrown askew upon the wearer's head and thus expose a portion of the wearer's head to falling objects or projectiles.

Accordingly, the present invention is designed to provide an improved headband useful in a helmet suspension system or the like which is readily adjustable in size, which automatically self-sets to accommodate a wearer having a head of larger size than the head size to which it was last adjusted, and which, when adjusted to the particular wearer, does not twist or yield if an object strikes the safety helmet.

SUMMARY OF THE INVENTION

The present invention is a headband which is useful in a helmet suspension system or the like. The headband comprises an elongated, flexible assembly generally ringlike in configuration with overlapping end portions. One end portion has generally parallel edges and opposed surfaces, and the other end portion is provided with a buckle member projecting from one side thereof. The buckle member further has end members for engaging both edges of the one end portion when the one end portion is received by the buckle member. A detent means for providing self-setting detent action in the relative movement of the one end portion with respect to the other end portion is provided by resilient deformation of either or both the buckle member and the one end portion.

BRIEF DESCRIPTION OF DRAWINGS

In the drawings:

FIG. 1 is a perspective view of a helmet suspension system including a first embodiment of the present invention with the helmet shown in phantom;

FIG. 2 is an enlarged fragmentary view in elevation of the headband adjusting means according to the embodiment of this invention shown in FIG. 1;

FIG. 3 is an enlarged cross-sectional view taken along line 3—3 of FIG. 2;

FIG. 4 is a partially sectioned view, taken along line 4—4 of FIG. 3;

FIG. 5 is a back view of FIG. 2;

BEST MODE FOR CARRYING OUT THE INVENTION

Figure 6:
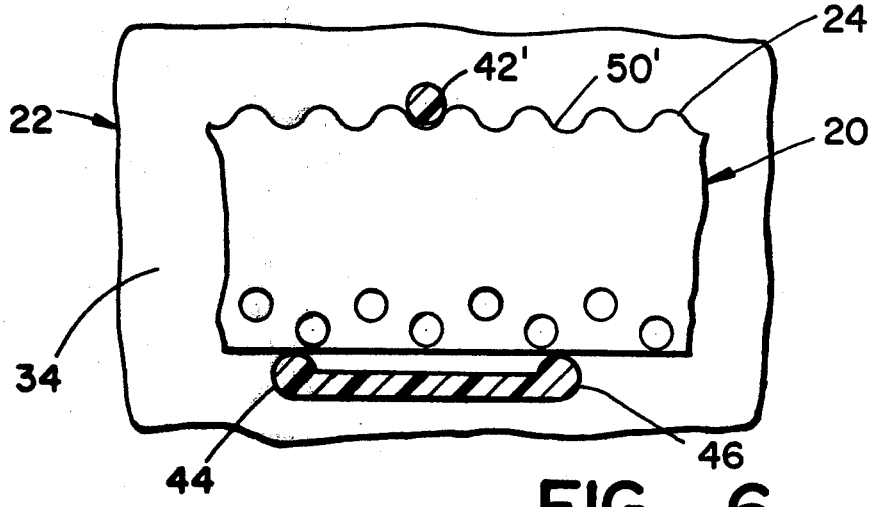
FIG. 6 is a partially sectioned view, similar to that of FIG. 4, but of a second embodiment of the present invention.

FIG. 1 illustrates the improved headband 10 of the present invention. Headband 10 comprises an elongated flexible assembly adapted to be formed into a generally ring-like configuration with end portions retained in overlapping relationship by an adjusting means. Headband 10 is useful in a helmet suspension system 11 associated with a safety helmet 12. As is known, the helmet suspension system 11 may comprise, for example, three crown straps 13, 14, 15 wherein two of the crown straps 13, 14 are attached to the helmet 12 and the headband 10 depends therefrom whereas one of the straps 14 is attached at points adjacent either side of a wearer's head to the helmet 12, but is either entirely free of the headband 10 (as illustrated in FIG. 1) or is loosely associated therewith as exemplified by U.S. Pat. No. 3,555,560.

In the preferred embodiments of the invention, and as illustrated by FIG. 1, the headband 10 comprises a rear portion 16 and a front portion 17 adapted to serve as a sweatband. A pair of adjusting means 18 are disposed in a bilateral symmetrical relationship with respect to a rim 19 of the helmet 12 between the rear portion 16 and the front portion 17 of the headband 10. Each adjusting means 18 is a mirror-image of the other. However, it should be understood that it is within the scope of the present invention that the headband may comprise a single adjusting means 18 or several thereof provided that at each adjusting means 18 the headband 10 is divided into a first end portion 20 and a second end portion 22 in overlapping relationship one with the other.

FIGS. 2–5 Embodiment

FIGS. 2;14 5 illustrate a first preferred embodiment of the present invention. Referring to FIG. 2, the first end portion 20 has a first edge 24 and a second edge 26. Edges 24,26 are substantially parallel with respect to each other along the first end portion 20. The first end portion 20 also has opposed outer 28 and inner 30 surfaces which are substantially flat and define parallel planes with respect to each other.

Referring to FIGS. 2 and 3, the second end portion 22 has an inside surface 32 and an outside surface 34. Projecting outwardly from and attached to the outside surface 34 of the second end portion 22 is a buckle member 36.

The buckle member 36 comprises a side member 40 mounted on the second end portion 22 by means of end members 42, 44 and 46. Side member 40 of buckle member 36 is adapted to loosely engage the outer surface 28 when the first end portion 20 is passed between side member 40 and the outer surface 34 of the second end portion 22. That is, the end members 42, 44, 46 of the buckle member 36 project from the outside 34 of the second end portion 22 to hold side member 40 a distance slightly greater than the distance between opposed surfaces 28 and 30 of the first end portion 20.

Turning to FIG. 4, the end members 42, 44, 46 of buckle member 36 provide compressive engagement of both edges 24 and 26 when the one end portion 20 is received in buckle member 36. The end members 42, 44 and 46 are spaced from each other so that the end members 44 and 46 compressively engage one edge 26 and end member 42 compressively engages the other edge 24 of the one end portion 20 when it is received in buckle member 36. That is, end members 42, 44, 46 cooperate with edges 24, 26 to bind the one end portion 20 during circumferential adjustment of the assembly 16 when it is in the ring-like configuration, illustrated by FIG. 1, with end portion 20 overlapping end portion 22.

The headband of the present invention also comprises a detent means 48 for providing a self-setting detent action in the relative movement of the first end portion 20 with respect to the second end portion 22.

To provide the self-setting action according to the first preferred embodiment of this invention, a plurality of closely spaced apertures 50 are defined by first end portion 20 and are adjacent one of the edges 24 or 26, herein illustrated as being adjacent first edge 24. The apertures 50 pass through the one end portion 20. At least one of the end members 42, 44, 46 herein illustrated as end member 42, is adapted to cooperate with apertures 50 to provide the desired detent action during relative movement of the one end portion 20 with respect to the other end portion 22.

The desired detent action is enhanced by the fact that the apertures 50 are substantially semicircular in shape with their linear edges 52 oriented substantially parallel to the first edge 24 of the first end portion 20. Thus, the linear edges 52 of each aperture 50 define individual deformable portions 54 of the first edge 24. End member 42 is formed by a nub so that as each of the apertures 50 is sequentially urged past end member 42 the end member 42 sequentially compressively deforms each of the portions 54 inwardly of the associated aperture 50. FIG. 4 illustrates end member 42 compressively deforming one of such portions 54 designated as **54*a*. Thus a detent action is provided wherein each of the apertures 50 represents a stop in a series of stops for the first end portion 20 as it passes through buckle member 36**.

The first end portion 20 is formed of a flexible resilient material so that the deformable portions 54 will return to their non-deformed condition when not in operative contact with end member 42. For example, the end portion 20 may be formed of a modified polypropylene plastic. The buckle member 36 may be formed of the same material, in which case both the end member 42 and the edge of the end portion 20 intermediate the apertures 50 may be compressively deformed during relative movement of the end portion 20 from one stop to the next. Alternatively, the buckle member 36 may be formed of a material which may be either more rigid or less rigid than the material of end portion 20 with appropriate structural dimensions to provide the desired detent action.

FIG. 6 Embodiment

A second preferred embodiment of the present invention is illustrated by FIG. 6 wherein the same reference numerals are used to designate corresponding parts. The primary difference between this embodiment and the embodiment described above in connection with FIGS. 2–5 resides in the apertures 50' and their cooperation with the end member 42' to provide the selfsetting detent action in the relative movement of the first end portion 20 with respect to the second end portion 22.

The apertures 50' according to this embodiment, intersect the edge 24 of the first end portion 20 to provide a sawtooth configuration at edge 24. As in the first embodiment, the first end portion 20 may be formed of a resilient material and the buckle member 36, more particularly the end member 42' may be formed of a material which is relatively more rigid than that of the first end portion 20. However, it is within the contemplation and scope of the present invention that the relative resilient-rigid properties of the first end portion 20 and the end member 42' may be equal to each other or reversed. Thus, the desired self-setting detent action in the relative movement of the first end portion 20 with respect to the second end portion 22 is provided by resilient compressive deformation of either or both the end member 42' of the buckle member 36 and the edge 24 of the first end portion 20 during relative movement thereof between one sawtooth aperture 50' and the next which provide stops in the detent action.

Figure 7:
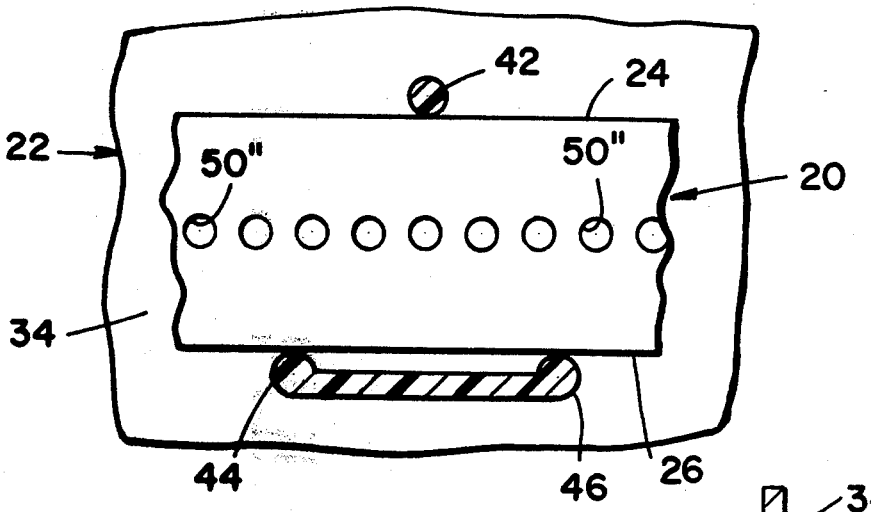
FIG. 7 is a partially sectioned view, similar to that of FIG. 4, but of a third embodiment of the present invention.
Figure 8:
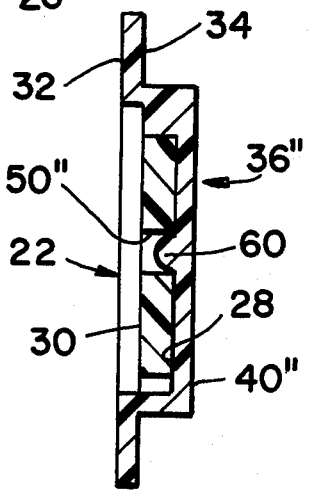
FIG. 8 is a cross-sectional view, similar to that of FIG. 3 but of the third embodiment.

Embodiment of FIGS. 7 and 8

The third preferred embodiment of the present invention is illustrated by FIGS. 7 and 8 wherein the same reference numerals are used to designate corresponding parts. The primary difference between the embodiments described above and that shown in FIGS. 7 and 8 resides in the positioning of the apertures 50" and their cooperation with the buckle member 36" to provide the self-setting detent action in the relative movement of the first end portion 20 with respect to the second end portion 22.

Referring to FIG. 7, the apertures 50" are spaced from both edges 24, 26 of the end portion 20 and are aligned to be substantially parallel therewith. Referring to FIG. 8, the side member 40" of buckle member 36" carries a nub 60 which projects inwardly toward the outside surface 34 of the second end portion 22 so as to interact with the apertures 50". Thus, each of the array of apertures 50" defines a stop in the desired self-setting detent action in the relative movement of the end portions 20 and 22 with respect to each other. The end portion 20 and the buckle member 36" may be made of appropriate material to provide compressive deformation of either or both during relative movement from one aperture 50" to the next.

In the preferred embodiments described above for the adjusting means 18 according to this invention, the end members 44, 46 are longitudinally spaced from each other to function as discrete engaging points, and end members 42 (42'), 44, 46 are in a truss-like relationship so that end members 42 (42'), 44, 46 represent the apexes of a triangle best illustrated by FIG. 5. This truss-like relationship provides that as the first end portion 20 is moved with respect to the second end portion 22, through buckle member 36 (36'), the end members 42 (42'), 44, 46 allow only overlapping movement therebetween produced by forces exerted symmetrically on the headband 10. Asymmetric forces exerted on the headband 10 will tend to produce a wedging action of either members 42 (42') and 46 or end members 42 (42') and 44 against opposite edges of the end portion 20 tending to prevent relative movement of end portions 20 and 22 with respect to each other.

Figure 9:
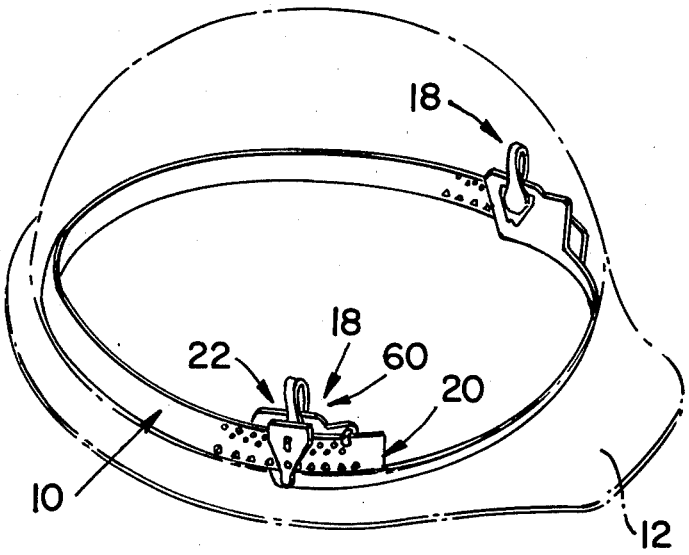
FIG. 9 is a perspective view of a helmet suspension system including a fourth embodiment of the present invention with the helmet shown in phantom.
Figure 11:
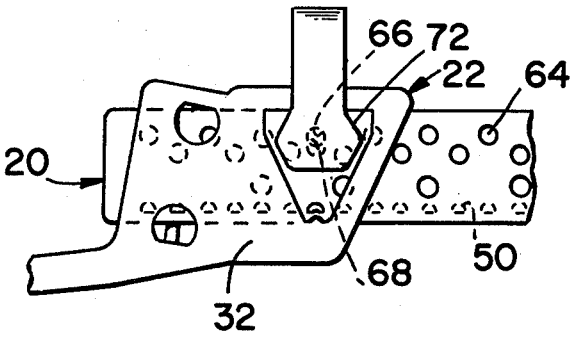
FIG. 11 is a back view of FIG. 10.

Embodiment of FIGS. 9 and 11

The fourth embodiment is substantially equivalent to the improved headband 10 illustrated by FIG. 1 and more particularly described and illustrated as the first preferred embodiment by FIGS. 2–5. A minor difference therebetween is that the first and second edges 24, 26 as illustrated by the FIGS. 9–11 embodiment are reversed in relative vertical orientation with respect to the FIGS. 2–5 embodiment. Such reversal is of substantially little or no structural or functional consequence. Accordingly, the structure of the fourth embodiment, as illustrated with reference to FIGS. 9–11 is described using the same reference numerals previously utilized to designate equivalent elements.

Figure 10:
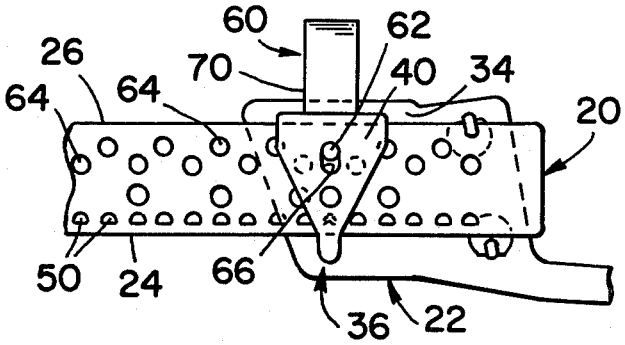
FIG. 10 is an enlarged fragmentary view in elevation of the headband adjusting means according to the embodiment of this invention shown in FIG. 9.

A primary difference between the FIGS. 2–5 embodiment and the FIGS. 9–11 embodiment is that the headband 10 preferably further comprises a means 60 for releasably locking the one end portion 20 with respect to the other end portion 22 to prevent relative movement therebetween.

The purpose of locking means 60 is to permit a particular user of headband 10, when headband 10 includes locking means 60, to optionally lock end portions 20, 22 together after the headband 10 has been self-set. It has been found that when relatively slow, steady force is exerted upon the central top area of helmet 12, such slow steady force will tend to loosen headband 10. Even after helmet 12 has been placed into self-setting adjustment of the size which comfortably fits the wearer, such slow, steady force tends to slightly loosen headband 10. This loosening is by end portion 20 tending to advance by one or two stops in the series provided by apertures 50. As has been previously described, however, such loosening does not occur when an asymmetric force, such as a falling object, is exerted on the headband 10. Rather, the slight loosening tends to occur in situations created by the user himself, such as, for example, when the user of a helmet 12 is in a crawl area, or in an area of limited height, and braces himself by means of his helmetted head. The consequent tendency toward slight loosening may result in a minor annoyance to the user after such a bracing action has occurred.

Referring to FIG. 9, locking means 60 preferably includes a pin 62 which is of a size to be snugly received into an orifice 64 of first end portion 20 and thence received into an orifice 66 of side member 40. A locking means 60 is included on each adjusting means and a pair of locking means 60 are thus shown in FIG. 9 due to the fact that the preferred headband 10 includes a pair of adjusting means 18. Each locking means 60 is the same as the other and, for convenience, only one pin 62, orifice 64 and orifice 66 shall now be further described as representative of both locking means 60.

Referring to FIG. 10, pin 62 may conveniently be carried by a flexible strap 68 having one end 70 attached to outside surface 34 of second end portion 22 adjacent buckle member 36.

Turning to FIG. 11, pin 62 is at other end 72 of strap 68. Other end 72 is of a shape and size so as to lie in the same plane as inside surface 32 when pin 62 has been fully inserted through an orifice 64. Thus, pin 62 is passed between outer and inner surfaces 30, 28 of first end portion 20, and each orifice 64, 66 is in an aligned relationship with a corresponding aperture 50.

Returning to FIG. 10, it may be understood therefrom that one orifice 64 is positioned directly in line with orifice 66 of buckle member 36 when first and second end portions 20, 22 are self-set by the detent action previously described. Pin 62 is easily threaded through orifice 64 and into engagement with orifice 66 so as to lock first and second end portions 20, 22 and prevent relative movement therebetween. With reference to FIG. 11, it may be understood that this locking is easily released by a user of headband 10 simply by grasping the other end 72 of strap 68 and withdrawing pin 62.

In the self-setting adjustment operation of the headband 10, as the wearer with a larger head size than that of the prior wearer places the headband 10, via helmet 12, upon his or her head, the downward placement force acting parallel to the intersection of the frontal and sagital planes of the head is transposed by the larger head to one or a plurality of symmetric forces acting in the transverse plane of the head, which results in a size for the headband 10 which comfortably fits the wearer, and wherein the headband 10 is stopped in a detent action at one of the series of stops provided by the apertures 50, 50' 50" in the first end portion 20.

End members 42 (42') 44, 46 and side member 40 are preferably integrally formed with the second end portion 22, as, for example, by processes such as injection molding, punching and the like.

In summary, four embodiments are disclosed of an improved headband 10 which is readily adjusted in size, which automatically self-sets to accommodate a wearer having a head of larger size than the head size to which it was last adjusted, and which does not twist or yield during use.

What is claimed is:

1. A self-setting adjustable headband for use in a helmet suspension system or the like, said headband comprising (a) an elongated flexible assembly adapted to be formed into an adjustable generally ring-like configuration with end portions thereof in overlapping relationship;

(b) one end portion of said elongated flexible assembly having generally parallel edges with one of said edges of said one end portion provided with a plurality of detent means;

(c) the other end portion of said elongated flexible assembly being provided with a buckle member projecting from one side thereof and adapted to receive said one end portion, said buckle member having end members spaced from each other to compressively engage the edges of said one end portion at points spaced further from each other along one edge than along the other edge thereof when received therebetween and a side member spaced from a surface of said other end portion so that the opposite surfaces of said one end portion are loosely engaged by said side member and said surface of said other end portion respectively when said one end portion is received therebetween; and (d) said end members of said buckle being adapted to cooperate with said detent means of said one end portion of said elongated flexible assembly to provide self-setting detent action in the relative movement of said one end portion with respect to said other end portion of said elongated flexible assembly.

2. A self-setting adjustable headband for use in a helmet suspension system or the like, said headband comprising (a) an elongated flexible assembly adapted to be formed into an adjustable generally ring-like configuration with end portions thereof in overlapping relationship;

(b) one end portion of said elongated flexible assembly having generally parallel edges with one of said edges of said one end portion provided with a plurality of detent means comprising a plurality of close spaced apertures through said one end portion adjacent said one edge thereof;

(c) the other end portion of said elongated flexible assembly being provided with a buckle member projecting from one side thereof and adapted to receive said one end portion, said buckle member having end members spaced from each other to compressively engage the edges of said one end portion when received therebetween and a side member spaced from a surface of said other end portion so that the opposite surfaces of said one end portion are loosely engaged by said side member and said surface of said other end portion respectively when said one end portion is received therebetween; and (d) said end members of said buckle member being adapted to cooperate with said detent means of said one end portion of said elongated flexible assembly to provide self-setting detent action in the relative movement of said one end portion with respect to said other end portion of said elongated flexible assembly.

3. The self-setting adjustable headband of claim 2 wherein;

said buckle member includes three end members arranged in a truss-like relationship with two of said end members engaging one edge of said one end portion and the third of said end members engaging the other edge of said one end portion of said headband.

4. The self-setting adjustable headband of claim 3 wherein said end members and said side member are integrally formed with the buckle member.

5. The self-setting adjustable headband of claim 3 wherein the assembly includes a sweatband.

6. The self-setting adjustable headband of claim 2 wherein:

said apertures through said one end portion are substantially semicircular in shape with a rectilinear portion thereof adjacent said one edge of said one end portion.

7. A self-setting adjustable headband for use in a helmet suspension system or the like, said headband comprising:

(a) an elongated flexible assembly adapted to be formed into a generally ring-like configuration with a front portion and a rear portion and a pair of adjusting means disposed between said front and rear portions, each of the adjusting means comprising an end portion of said front portion and an end portion of said rear portion in overlapping relationship;

(b) the first end portion of each said adjusting means having parallel edges with a plurality of detent means at a first edge of said first end portion;

(c) the second end portion of each said adjusting means being provided with a buckle member projecting from an outside thereof and adapted to receive said first end portion, said buckle member having end members spaced from each other to compressively engage the edges of said first end portion at points spaced further from each other along one edge than along the other edge thereof when received therebetween and a side member spaced from the outside surface of said second end portion so that the opposite surfaces of said first end portion are loosely engaged by said side member and said surface of said second end portion respectively when said first end portion is received therebetween; and (d) said end members of said buckle member being adapted to cooperate with said detent means of said first end portion of each said adjusting means to provide a self-setting detent action in the relative movement of said first end portion with respect to said second end portion of each said adjusting means.

8. A self-setting adjustable headband for use in a helmet suspension system or the like, said headband comprising:

(a) an elongated flexible assembly adapted to be formed into a generally ring-like configuration with a front portion and a rear portion and a pair of adjusting means disposed between said front and rear portions, each of the adjusting means comprising an end portion of said front portion and an end portion of said rear portion in overlapping relationship;

(b) the first end portion of each said adjusting means having parallel edges with a plurality of detent means at a first edge of said first end portion comprising closely spaced apertures of substantially semi-circular shape adjacent said first edge of said first end portion;

(c) the second end portion of each said adjusting means being provided with a buckle member projecting from an outside thereof and adapted to receive said first end portion, said buckle member having end members spaced from each other to compressively engage the edges of said first end portion when received therebetween and a side member spaced from the outside surface of said second end portion so that the opposite surfaces of said first end portion are loosely engaged by said side member and said surface of said second end portion respectively when said first end portion is received therebetween; and (d) said end members of said buckle member being adapted to cooperate with said detent means of said first end portion of each said adjusting means to provide a self-setting detent action in the relative movement of said first end portion with respect to said second end portion of each said adjusting means.

9. The self-setting adjustable headband of claim 8 wherein:

said buckle member includes three end members arranged in a truss-like relationship with two of said end members engaging one edge of said one end portion and the third of said end members engaging the other edge of said one end portion of said headband.

10. The self-setting adjustable headband of claim 9 wherein:

each said first end portion has a plurality of orifices adjacent the second edge thereof.

11. The self-setting adjustable headband of claim 9 wherein said front portion comprises a sweatband.

12. A self-setting adjustable headband for use in a helmet suspension system or the like, said headband comprising:

(a) an elongated flexible assembly adapted to be formed into an adjustable generally ring-like configuration with end portions thereof in overlapping relationship;

(b) a one end portion of said elongated flexible assembly having generally parallel edges and opposed surfaces;

(c) the other end portion of said elongated flexible assembly having a buckle member projecting from one side thereof, said buckle member having end members spaced from each other and a side member spaced from said one side of said other end portion, said buckle member being adapted to receive said one end portion with said edges of said one end portion engaging said end members over a greater distance along one edge than along the other edge thereof and with said surfaces of said one end portion being engaged with said side member and said one side of said other end portion respectively; and (d) a plurality of detent means spaced from each other along said one end portion adapted to cooperate with said buckle member to provide a self-setting detent action in the relative movement of said one end portion with respect to said other end portion.

13. The self-setting adjustable headband of claim 12 wherein;

said detent means comprise a plurality of spaced apertures through said one end portion adapted to cooperate with said buckle member to provide said self-setting detent action.

14. The self-setting adjustable headband of claim 13 wherein;

said apertures intersect one edge of said one end portion and are adapted to receive one of said end members of said buckle member to provide said self-setting detent action.

15. The self-setting adjustable headband of claim 13 wherein:

said apertures are arranged in a rectilinear array spaced from and substantially parallel to said edges of said one end portion; and, said side member of said buckle member carries a nub projecting therefrom into operative engagement with said array of said apertures to provide said self-setting detent action.

16. A self-setting adjustable headband for use in a helmet suspension system or the like, said headband comprising:

(a) an elongated flexible assembly adapted to be formed into an adjustable generally ring-like configuration with end portions thereof in overlapping relationship;

(b) a one end portion of said elongated flexible assembly having generally parallel edges and opposed surfaces;

(c) the other end portion of said elongated flexible assembly having a buckle member projecting from one side thereof, said buckle member having end members spaced from each other and a side member spaced from said one side of said other end portion, said buckle member being adapted to receive said one end portion with said edges of said one end portion engaging said end members at points spaced further from each other along one edge than along the other edge thereof and with said surfaces of said one end portion being engaged with said side member and said one side of said other end portion respectively; and (d) a plurality of detent means spaced from each other along said one end portion adapted to cooperate with said buckle member to provide a self-setting detent action in the relative movement of said one end portion with respect to said other end portion, said detent means comprising a plurality of spaced apertures through said one end portion adapted to be deformed by said buckle member to provide said self-setting detent action.

17. The self-setting adjustable headband as claimed in claim 1, claim 7 claim 12 claim 2, claim 8 or claim 16, further comprising:

(e) means for releasably locking said first end portion with said second end portion to prevent the relative movement therebetween allowed by said detent means.

* * * * *